United States Patent [19]

Martin

[11] Patent Number: 4,807,724

[45] Date of Patent: Feb. 28, 1989

[54] HYDRAULIC DRIVE SYSTEM FOR ELEVATOR

[75] Inventor: Donnie L. Martin, Mercersburg, Pa.

[73] Assignee: D. L. Martin Company, Mercersburg, Pa.

[21] Appl. No.: 176,062

[22] Filed: Mar. 31, 1988

[51] Int. Cl.[4] ..... B66B 9/04

[52] U.S. Cl. ..... 187/110; 187/17

[58] Field of Search ..... 187/17, 110, 111

[56] References Cited

U.S. PATENT DOCUMENTS

| | | | |
|---|---|---|---|
| 449,662 | 4/1891 | Baxter, Jr. | 187/110 X |
| 2,417,947 | 3/1947 | Reedy | 187/110 X |
| 3,252,547 | 5/1966 | Hornedo | 187/17 |
| 4,069,923 | 1/1978 | Blumenau et al. | 187/17 X |

*Primary Examiner*—William M. Shoop, Jr.
*Assistant Examiner*—W. E. Duncanson, Jr.
*Attorney, Agent, or Firm*—Pollock, Vande Sande & Priddy

[57] ABSTRACT

In an energy efficient hydraulic elevator driving system, a substantially constant amount of pressurized fluid is displaceable within a closed system between two hydraulic jacks with a piston-cylinder combination interconnected by a piping system. The translational movement of a shaft engaging the piston in the first cylinder is transmitted through fluid to the second cylinder to effect movement of the hydraulic jack for lowering and raising the elevator car. A counter-weight is provided at the opposite end of the shaft which constantly compresses the pressurized fluid in the first cylinder and balances the weight of the elevator car which is supported by a hydraulic jack plunger. Therefore only a relatively small amount of additional energy is necessary to lower and raise the elevator car.

13 Claims, 4 Drawing Sheets

HYDRAULIC DRIVE SYSTEM FOR ELEVATOR

FIELD OF INVENTION

The present invention relates to elevator systems and particularly to hydraulic driving system using hydraulic jacks for lowering and raising an elevator car.

BACKGROUND OF THE INVENTION

Hydraulic driving systems for lowering and raising elevator cars which employ hydraulic jacks for supporting the weight of the elevator car and the passengers are well-known in the art. A typical hydraulic jack has a stroke of about 10 to about 80 feet and 1 to 8 stop positions. In such well-known hydraulic jacks, a hydraulic fluid, such as oil, in a jack cylinder is pressurized by a pump which pumps fluid from a reservoir through a filter, control valve, insulator coupling and piping connection to the jack cylinder. The pump is driven by an electric motor which is necessarily large sized, to carry a full load every time to move the elevator.

Systems for driving a hydraulic jack of the conventional elevator use a complicated control system with a large number of electrical and mechanical elements, which require frequent and troublesome maintenance. Large amounts of fluid pumped at high pressures through small restrictions causes high vibrations and noisy operation of the elevator system. Also the large size of the electrical motor necessary to drive a pump pressuring the fluid in the jack requires a substantially large amount of electrical energy.

In the conventional hydraulic elevator driving system, positioning of the elevator car is determined by microswitches at each floor sending signals to the flow regulating control valve, so that separate calibration for each floor is necessary.

The purpose of the present invention is to replace the sophisticated, elevator hydraulic driving system with above-described disadvantages by a simple, energy efficient, easy-to-maintain, and long-life reliable driving system for an elevator's hydraulic jack.

SUMMARY OF THE INVENTION

It is a purpose of the present invention to provide an energy efficient, hydraulic driving system for lowering and raising an elevator car with substantially reduced electrical power consumption.

It is another purpose to provide a simple hydraulic driving system in which many mechanical and electrical components of conventional prior art elevator driving systems have been eliminated.

It is still another purpose of the present invention to provide a hydraulic driving system with increased reliability and safe operation due to its extremely simple structure which eliminates use of hydraulic valves, hydraulic pump, fluid reservoir and filtering system, insulating couplers, mufflers, heaters, and coolers.

It is another purpose to provide a driving system with smooth and quiet operation of the elevator car since the hydraulic fluid in the system does not pas through acute restrictions which cause heat and flow vibrations, thus eliminating ultrasonic noise.

The above objects of the present invention are accomplished by a structure for a hydraulic driving system in which a substantially constant amount of pressurized fluid, such as for example oil, is displaceable in a closed system between two hydraulic jacks with piston-cylinder combinations in which the cylinders are interconnected by a piping system.

The translational movement of a shaft engaging the piston in the first cylinder is transmitted through fluid to the second cylinder to effect movement of the hydraulic jack for lowering and raising the elevator car.

A counter-weight is provided at the opposite end of the shaft which constantly compresses the pressurized fluid in the first cylinder and balances the weight of the elevator car which is supported by a hydraulic jack plunger. Therefore only a relatively small amount of additional energy is necessary to lower and raise the elevator car. The total weight of the elevator car, jack plunger and the load to be carried by the elevator car are taken into consideration in determining the amount of counter-balance weight. Also the ratio between the diameters of the jack cylinder and the injector cylinder are determined so that a relatively small vertical movement of the piston in the injector cylinder effects a large vertical movement of the jack plunger supporting the elevator car.

In one preferred embodiment of the present invention a rack and pinion combination is used for converting the rotational movement of the electrical motor shaft driving the hydraulic injector system to translational movement of the injector shaft which provides a smooth and quiet operation of the elevator car.

In a preferred embodiment of the present invention means are provided for collecting any leakage of the pressurized fluid in the hydraulic jacks and the driving injector system. After a predetermined amount of leaking fluid accumulates, it is injected back into the system so that the reliability of the system is maintained by a constant amount of pressurized fluid.

The hydraulic elevator system according to the present invention is accurate, simple and inexpensive to control since it only requires a change in the rotating direction of the electric motor from clockwise to counter-clockwise to effect lowering and raising of the elevator car.

In the preferred embodiment of the present invention a calibration system for the evelator car includes microswitches which may only be needed at the designated "home floor". Additional stops are constant from the "home floor".

In the present invention. the hydraulic injector is designed so that the piston in the cylinder touches the bottom before a stop ring in the elevator jack contacts the elevator head. This constitutes a very desirable safety feature allowing elimination of the cushioning mechanism otherwise required in the elevator jack by safety regulations.

Other advantages achievable by the present invention will become apparent from the following description of the preferred embodiment of the present invention with reference being made to the accompanying drawings.

BEST AND VARIOUS MODES FOR CARRYING OUT THE INVENTION

Figure 1:
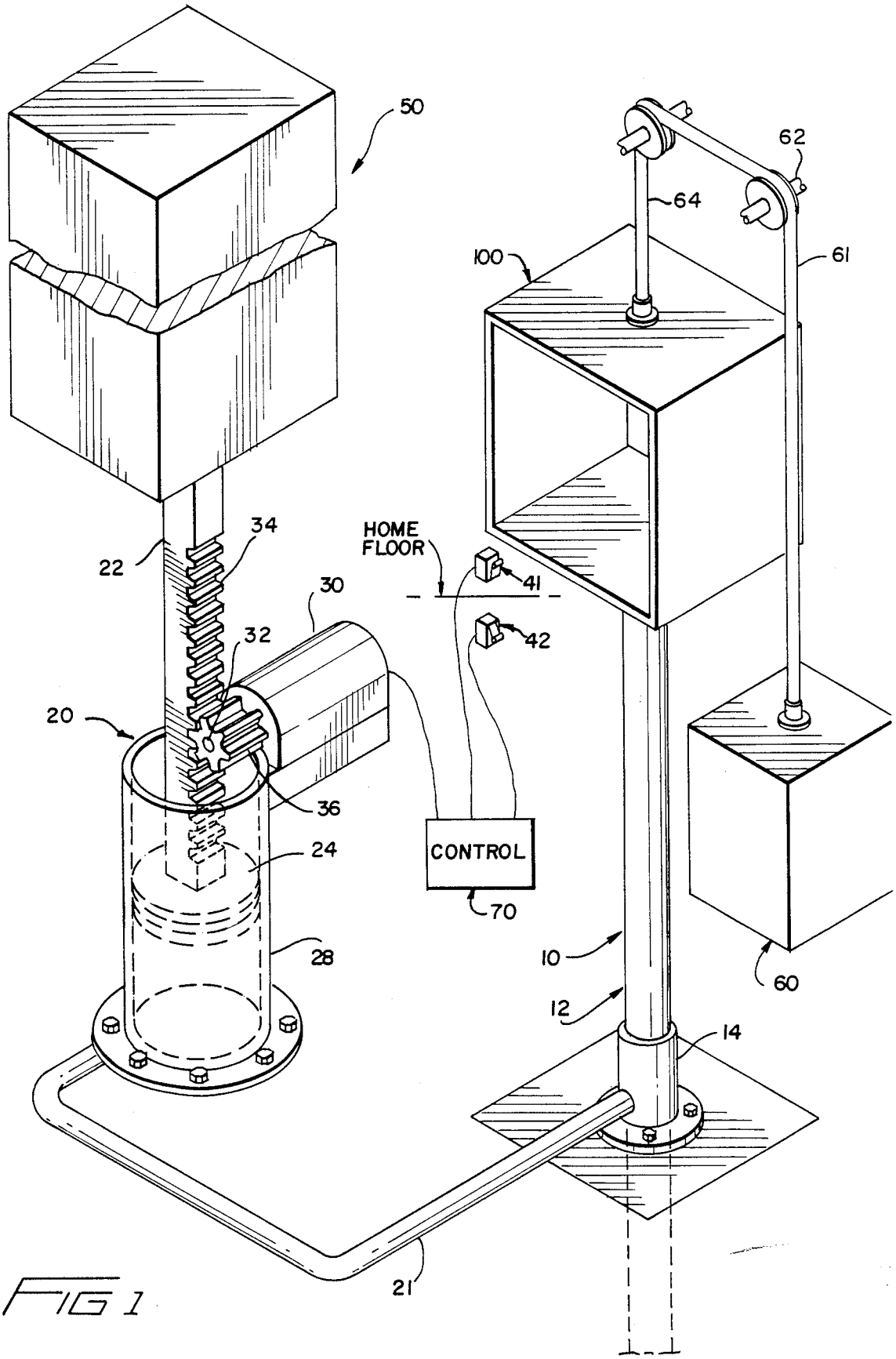
FIG. 1 shows an elevation view of the elevator system according to the present invention.

In a hydraulically operated elevator system shown in FIG. 1, the elevator car is operated by a hydraulic jack (10). The hydraulic jack includes a piston-cylinder combination which effects vertical movement of a jack plunger (12) within the sealed cylinder column (14) of the hydraulic jack (10). Elevator car (100) is vertically supported by the jack plunger (12). The vertical movement of the jack plunger (12) raises and lowers the elevator car (100).

As shown in FIG. 1, in the preferred embodiment of the present invention the cylinder column (14) is secured below floor level to store the jack plunger (12) when the elevator car (100) is lowered. Oil can be used as pressurized fluid for the system. Also a solution of oil and water which is less sensitive to temperature changes can be a suitable medium. The fluid mixture need only contain enough oil to prevent rust and corrosion.

Figure 2:
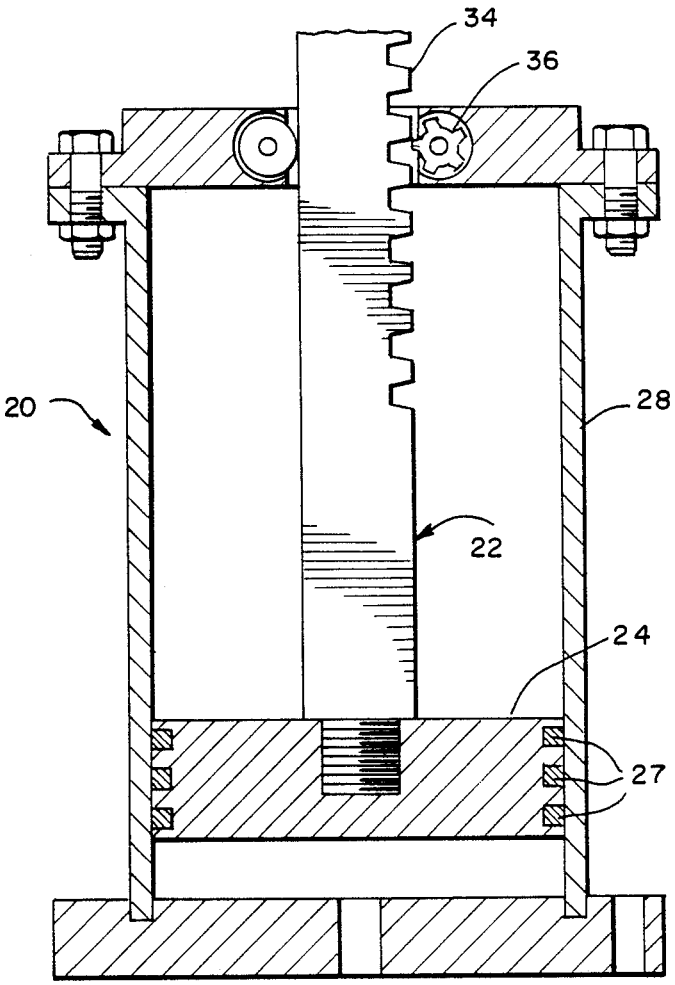
FIG. 2 shows a view in cross-section of one embodiment of the hydraulic injector system, according to the present invention.

Driving means for the hydraulic jack (10) includes hydraulic injector system (20). The hydraulic injector system (20) constitutes another piston-cylinder combination. A vertically moveable shaft (22) is engaged by the piston (24) which is provided with sealing means to prevent leaking of the hydraulic fluid from the top portion of the cylinder (28). As best shown in FIG. 2, in the preferred embodiment the sealing means includes three seals (27).

As shown in FIG. 1, an electrical motor (30), either AC or DC, provides power for the hydraulic injector system (20). The rotational movement of the motor shaft (32) is converted into translational movement of the injector shaft (22) by use of a rack and pinion combination. A rack gear (34) is disposed on the injector's vertical shaft (22) and is in driving engagement with the pinion gear (36) secured to the motor shaft (32). The rotational speed and direction of the electric motor (30) is controlled by a control system (70) which can preferably be a micro-processor so that the motor is driven clockwise or counter-clockwise and the piston-shaft (22) is raised or lowered depending on the direction of the motor shaft rotation.

In one preferred embodiment of the present invention shown in FIGS. 1 and 2, a rack-pinion combination is used for conversion of rotational to translational movement of the injector's shaft, however other means could also be employed such as ball screw and nut combination; standard threaded screw and nut, or a hydraulic ram, etc.

Figure 3:
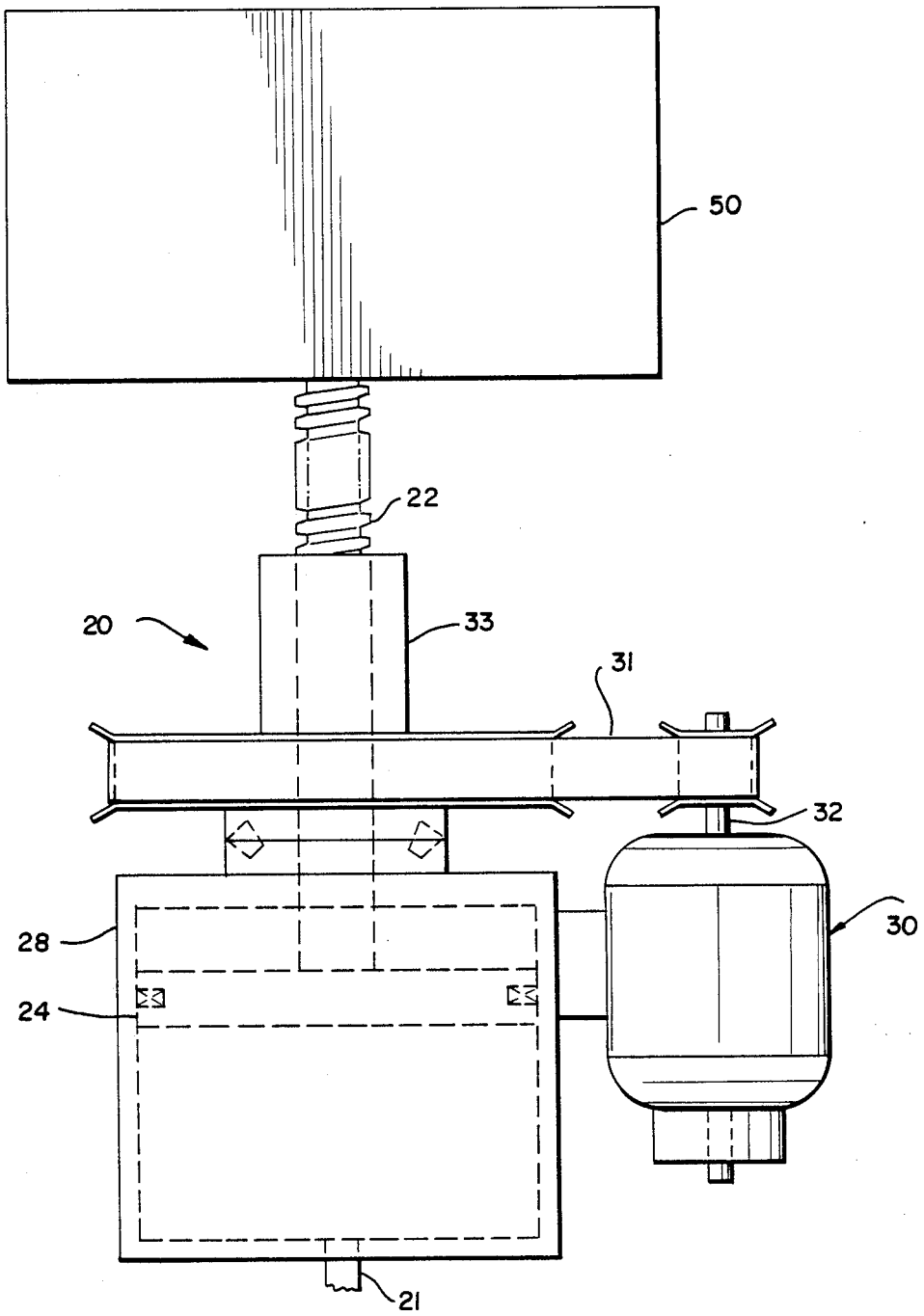
FIG. 3 shows a cross-sectional view of a second embodiment of a hydraulic injector system.

FIG. 3 shows another embodiment in which the conversion of the rotational movement of the motor shaft into translational movement of the shaft is accomplished by providing on the a shaft a ball screw/nut combination (33) connected to the motor shaft by a belt (31). For example standard ball screws manufactured by Warner Company can be employed A counter-weight (50) is provided at the opposite end of the vertical shaft (22) in the hydraulic injector (20). The size of the counter-weight (50) is determined by the jack plunger column loading of the hydraulic jack (10) supporting the elevator. Such loading is determined by a designated load to be carried, length of travel, any counter balancing of the car, and the like. The weight differential determines the size of the electrical motor.

Also the ratio between the jack cylinder diameter and injector cylinder diameter is selected which in turn determines the size of the injector cylinder. In the preferred embodiment the ratio of diameters is about 12 to 1. The counter-weight (50) on the top of the shaft acting on the piston (24) in the injector cylinder (28) provides compression to the hydraulic fluid. The counter-weight (50) can be guided in the rails (not shown). Due to the presence of the counter-weight, the size of the electric motor effecting movement of the shaft in the cylinder containing pressurized fluid can be substantially reduced such as to about 10% of the size necessary for conventional elevators so that the system can operate very efficiently with a substantially (up to 90%) reduced electrical energy consumption.

The piston (24) of the hydraulic injector (20) is provided with seals (27) to substantially prevent leakage of the hydraulic fluid from the top portion of the injector. A pipe line (21) connects the bottom of the injector cylinder (28) to the cylinder column (14) of the hydraulic jack (10) with a substantially constant amount of pressurized fluid being present and displaceable in two directions between the cylinders (14, 28) through the piping line (21).

The relatively small vertical movement of the piston (24) in the cylinder (28) of the hydraulic injector (20) provides additional compression to the pressurized fluid which is transmitted to the hydraulic jack plunger (12) and regulates the height of the elevator car over a vertical travel range of as much as about 80 feet. The counter-clockwise rotation of the electrical motor (30) increases the force o the injectors piston (24) and an additional volume of hydraulic fluid is forced through the piping line (21) and into the jack column (14). The force on the fluid will raise the jack plunger (12) and the elevator car (100) will be raised.

The rotation of the motor in a clockwise direction moves the piston upwardly into the injection cylinder and permits hydraulic fluid to flow back to the injector cylinder (28) therefore moving the jack plunger (12) downwardly and lowering the elevator car (100).

An additional counter-weight (60) can be connected directly to the top of the elevator car by steel cables (61) and pulleys (62) secured to the top of the elevator shaft (64) which can be further used to optimize the size of the electrical motor (30) and the cylinders (14,28). The position of the elevator car (100) is determined by the position of the piston (24) which is determined in turn by the rotation of the motor (30) in response to the electrical control system (70). The elevator car is stopped at a designated height for floors 1, 2, 3, etc.

During the normal operation of the system, a substantially constant mass of hydraulic fluid in the system may vary slightly in volume due to fluctuations in temperature which cause, in turn, a variation in the positioning of the elevator car. The appropriate adjustment must be made to allow calibration and accurate positioning of the car. The adjustment is accomplished by use of micro-switches at the floor level designated as "home floor" and the appropriate signal is sent to the control unit (70) when the car is in the correct position for the home floor. The control unit also uses such signal to calibrate the stop position for variations caused by loss of some amount of hydraulic fluid in the same way.

Micro-switches (41,42) are provided at "home floor position" in a conventional manner, and a signal is obtained when the elevator car (100) trips particular switch. When the rotation of the motor is stopped by the control unit the elevator car is also stopped. A complete electrical calibration is made at the home floor position and other stops are maintained constant from this point. Any floor may be designated as "home floor."

As described above, the present invention elevator driving system provides for an automatic floor horizontal levelling compensator and calibrator. Every time when the elevator car comes to the "home floor" it is referenced with micro-switches or other appropriate devices, and an appropriate control signal is sent to the controller to make the necessary adjustment for loss of fluid from temperature changes causing a displacement in the system. Since all of the floor stops are fixed, stationary and consistent, any floor can be designated as a "home floor" for horizontal levelling and calibration. The information indicating correct position of the elevator car is stored in the controller which is in the preferred embodiment is a microprocessor, and all of the other stops are accurate since they are proportionally spaced from the "home floor", and the jack plunger movement is controlled by very positive displacement of injector piston governed by a rack-pinion or ball screw/nut combination.

Figure 5:
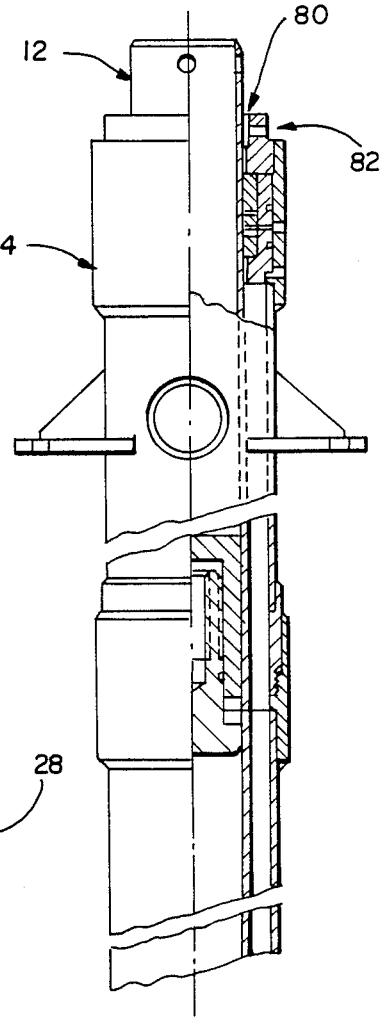
FIGS. 4 and 5 show in cross-section a partial view of the hydraulic injector and elevator jack with a system for collecting fluid leakage.
Figure 4:
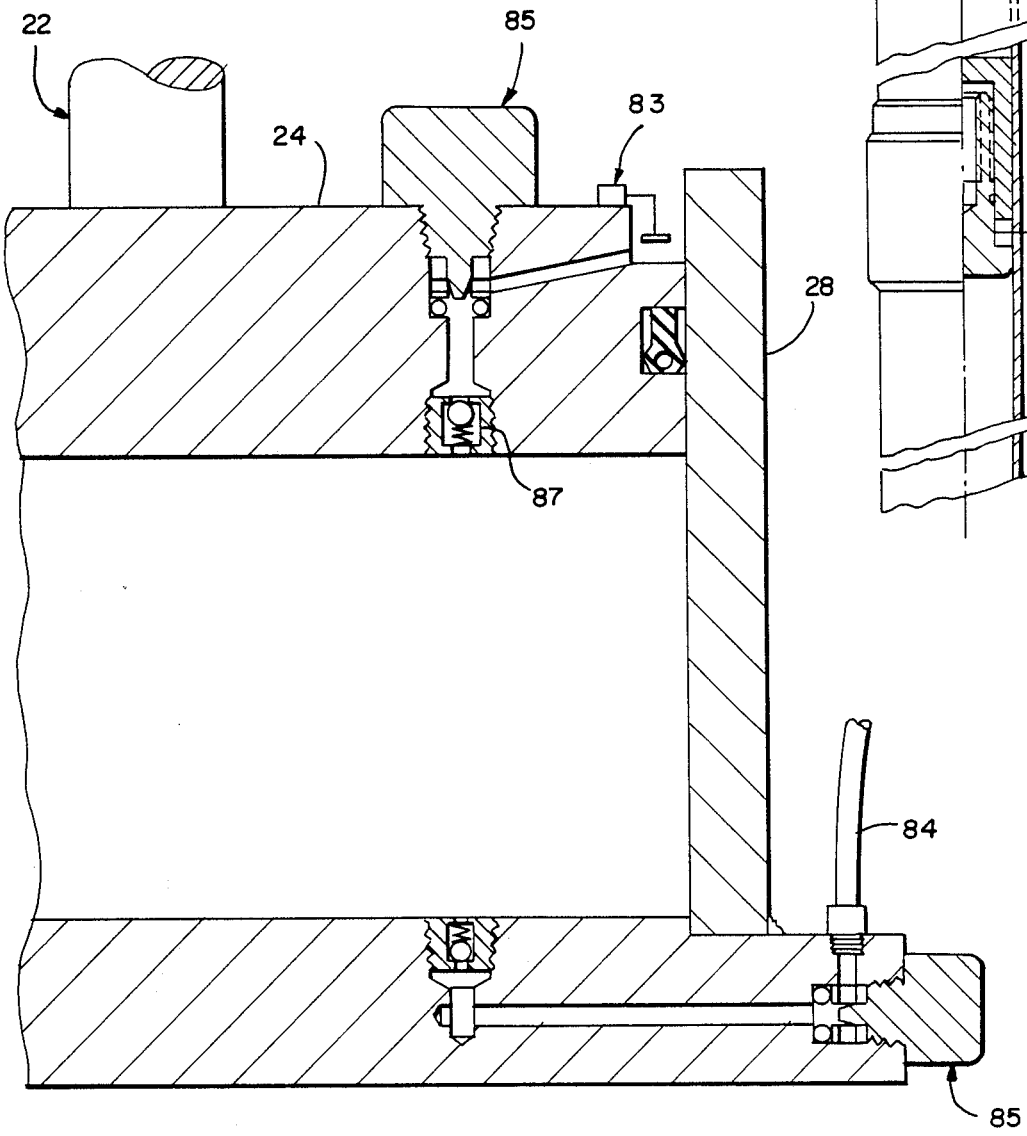

As shown in FIGS. 3, 4 and 5, the reliability of the elevator driving system is enhanced by provision of means for collecting any leakage of pressurized fluid from the injector cylinder seal and jack seal and injecting the pressurized fluid back into the system when the predetermined amount of fluid accumulates.

FIGS. 4 and 5 show means for collecting leaking fluid. A reservoir (80) for collecting leakage of oil includes port (82) for draining. The hydraulic fluid can be brought back to the injector piston (24) by a plastic line (84). The fluid that by-passes the injector seals (27) will accumulate in the pocket on the top of the injector piston and when the float energizes the microswitch (83) the solenoid (85) starts pumping the fluid back into the system under pressure. The one way ball valve (87) insures zero leakage below the plunger. An excessive amount of leakage would indicate seal wear.

The present invention system, including the hydraulic injector, mechanical connection to the electrical motor, such as the rack and pinion combination, counter-weight and control unit allow replacement of various conventional elements of the hydraulic control system such as valve, pump, reservoir, filter and muffler.

A simple hydraulic elevator system including two piston-cylinder combinations interconnected by a piping system for displacement of a substantially constant amount of pressurized hydraulic fluid therebetween provides a driving system inexpensive to control due to the very small number of working parts and simplicity of control. As can be clearly seen from FIG. 1, the counter-balance weight provided on top of the shaft (22) retains the hydraulic fluid under pressure to effect upward movement of the elevator when it is rotated counter-clockwise and downward movement when the motor is rotated clockwise. The operation of the elevator is smooth and quiet as the hydraulic fluid does not pass through acute restrictions which can cause heat and flow vibrations.

The elevator system according to the present invention is relatively simple and the life of the rack and pinion drive mechanism or ball screw, nut arrangement used in the preferred embodiments is extended as only a small driving force motor is required due the counter-balance weight used within the system.

An electrically operated disc brake may be mounted at the rear of the motor is provided to stop the motor in the event of improper operation.

A flow restrictor can be used in the porting from the hydraulic jack cylinder column which blocks the fluid flow should a pressure loss occur to prevent an unsafe operating condition.

It will be understood that variations and modifications may be effected without departing from the spirit and scope of the novel concepts of the present invention.

Having thus described our invention, what we claim as new and desire to secure by Letters Patent is:

1. A system for raising and lowering an elevator comprising:

(a) a vertically-oriented first hydraulic jack operatively connected to move said elevator vertically, said hydraulic jack including a first piston-cylinder combination;

(b) a second hydraulic jack including a second piston/cylinder combination and a vertically movable shaft engaged by the piston of said second piston/-cylinder combination;

(c) an interconnection pipe hydraulically joining the cylinder of said first piston/cylinder combination with the cylinder of said second piston/cylinder combination;

(d) drive means for providing a rotational motion;

(e) means for converting said rotational motion into translational motion of said shaft means; and (f) hydraulic fluid within said first and second piston/-cylinder and interconnection pipe, whereby downward movement of said shaft raises said elevator and an upward movement of said shaft lowers said elevator.

2. A system according to claim 1 wherein said drive means includes an electric motor.

3. A system according to claim 2 wherein said means for converting rotational motion into translational motion comprises a pinion connected to a shaft of said electric motor in a driving engagement with a rack on said vertically movable shaft.

4. A system according to claim 1 or 3 further comprising a counter-weight for counterbalancing the weight of said elevator car

5. A system according to claim 4 wherein said counter-weight is connected to one end of said shaft of said second hydraulic jack.

6. A system according to claim 2 wherein said means for converting rotational motion into translational motion comprises a ball screw nut combination provided on said vertically movable shaft and a belt interconnecting said nut to a shaft of said motor.

7. A system according to claim 5 further comprising sealing means connected to each piston for substantially preventing leakage of said hydraulic fluid.

8. A system according to claim 7 wherein said hydraulic fluid is a soluble oil and water solution.

9. A system according to claim 7 further comprising mean for collecting any fluid bypassing said sealing means and returning said collected fluid back to said system.

10. A hydraulic driving system for operating of an elevator car comprising:

(a) a hydraulic jack supporting said elevator car;

(b) an injector for pressuring a non-corrosive medium in said jack;

(c) piping for hydraulically connecting said injector with said hydraulic jack;

(d) said injector including a cylinder having an opening at one end thereof in connection with said piping and a piston axially movable for changing the volume of said medium in said cylinder, and transmitting said pressurized medium to and from said hydraulic jack through said piping line for lowering and raising said elevator car.

11. A hydraulic system according to claim 10 wherein said injector is provided with a counter-weight for balancing weight of said elevator car.

12. A hydraulic system according to claim 11 wherein said piston is vertically movable in said cylinder by driving means including an electrical motor and means for converting rotational movement of a shaft of said motor into translational movement of said piston.

13. A hydraulic system according to claim 11 wherein said means for converting rotational motion into translational motion comprises a pinion connected to a shaft of said electric motor in a driving engagement with a rack on said vertically movable shaft.

* * * * *